US005970611A

United States Patent [19]

Takabe et al.

[11] Patent Number: 5,970,611

[45] Date of Patent: Oct. 26, 1999

[54] METHOD FOR PROCESSING A ROTOR USED FOR A SUPER CHARGER

[75] Inventors: Shigeru Takabe, Sagamihara; Kouichi Kuroda; Kazuyuki Nakasuji, both of Osaka, all of Japan

[73] Assignee: Ishikawajima-Harima Heavy Industries Co., Ltd., Tokyo, Japan

[21] Appl. No.: 08/944,130

[22] Filed: Oct. 6, 1997

[30] Foreign Application Priority Data

Oct. 31, 1996 [JP] Japan ..... 8-290724

[51] Int. Cl.[6] ..... B23P 15/00

[52] U.S. Cl. ..... 29/888.023; 29/890.036

[58] Field of Search ..... 72/98, 100; 29/888.023, 29/890.036, 890.053, 889

[56] References Cited

U.S. PATENT DOCUMENTS

| | | | |
|---|---|---|---|
| 4,175,414 | 11/1979 | Peytavin | 72/100 |
| 4,395,896 | 8/1983 | Yoshiwara et al. | 72/100 |
| 4,403,385 | 9/1983 | Kirk | 29/890.036 |
| 4,612,791 | 9/1986 | Przybyla et al. | 29/890.036 |
| 4,915,166 | 4/1990 | Cunningham et al. | 72/98 |

FOREIGN PATENT DOCUMENTS

| | | | |
|---|---|---|---|
| 0 514 040 | 11/1992 | European Pat. Off. | F02B 33/34 |
| 0 695 598 | 2/1996 | European Pat. Off. | B23K 20/04 |
| 1 384 329 | 2/1975 | United Kingdom | B21H 3/04 |

OTHER PUBLICATIONS

Patent Abstracts of Japan, vol. 095, No. 008, Sep. 29, 1995 & JP 07 139542, May 30, 1995.

Patent Abstracts of Japan, vol. 013, No. 458, Oct. 17, 1989 & JP 01 178384, Jul. 14, 1989.

Patent Abstracts of Japan, vol. 095, No. 008, Sep. 29, 1995 & JP 07 132338, May 23, 1995.

Patent Abstracts of Japan, vol. 016, No. 287, Jun. 25, 1992 & JP 04 075739, Mar. 10, 1992.

Patent Abstracts of Japan, vol. 012, No. 251, Jul. 15, 1988 & JP 63 036903, Feb. 17, 1988.

Patent Abstracts of Japan, vol. 012, No. 374, Oct. 6, 1988 & JP 63 126602, May 30, 1988.

Patent Abstracts of Japan, vol. 012, No. 260, Jul. 21, 1988 & JP 63 043719, Feb. 24, 1988.

*Primary Examiner*—Irene Cuda

*Attorney, Agent, or Firm*—McCormick, Paulding & Huber LLP

[57] ABSTRACT

In a method for processing a rotor used for a supercharger and the like, a slanted rolling machine is used having rolls designed such that the rolls are arranged about a pass line along which a material to be molded advances. Each roll is of corn shape and has a plurality of spiral-shaped grooves formed on its side surface. A shaft member made from iron or a similar material is inserted into an aluminum alloy tube. The aluminum alloy tube with the shaft member inside it is continuously fed to the slanted rolling machine along the pass line. Then, the periphery of the aluminum alloy tube is rolled/spread by the rolls for forming spiral shaped teeth from the tube material and for metallurgically attaching the tube to the shaft member.

7 Claims, 2 Drawing Sheets

METHOD FOR PROCESSING A ROTOR USED FOR A SUPER CHARGER

BACKGROUND OF THE INVENTION

1. Technical Field

The present invention relates to a method for processing a rotor used for a supercharger and the like.

2. Background Art

In a supercharger, a screw compressor, a roots blower, a Lysholm compressor and the like, each rotor includes a shaft member, in the form of a shaft and a rotor portion around the shaft member. The shaft member is made from rigid carbon steel, while the rotor portion is made from aluminium alloy that has excellent processability. In manufacturing the rotor, the shaft member and an aluminium profile portion constituting the rotor portion are integrally attached with each other by methods like shrinkage fit or internal chill.

However, the shrinkage fit method requires aluminium material of high rigidity to be used as the rotor portion. Such aluminium alloy of high rigidity is not only expensive but also has other problems like the difficulty to make it near net shape, low productivity and higher production cost. On the other hand, the internal chill method, though it reduces production cost and allows the near net shape processing, still shows low productivity.

SUMMARY OF THE INVENTION

An object of the present invention is to provide a method for processing a rotor in which method both near net shape processing and higher productivity can be achieved solving the aforementioned problems.

According to the method of the present invention for achieving that purpose, when a rotor used for a supercharger and the like is processed utilizing a slanted rolling machine (the slanted rolling machine has rolls arranged around a pass line along which the material to be molded proceeds and a plurality of spiral-shaped grooves is formed on each roll), a shaft member made from iron etc. is at first inserted into an aluminium alloy tube. This aluminium alloy tube having the shaft member inside of it is then continuously fed into the slanted rolling machine through the pass line. The periphery of the aluminium alloy tube is thus rolled and spread to form spiral shaped teeth, also attaching the aluminium alloy tube to the shaft member.

In addition, the rolling/spreading of the aluminium alloy tube by the slanted rolling machine is performed with spread factor of (preferably) more than 2 in either hot rolling or cold rolling.

Further, the periphery surface of the shaft member of iron or a similar material is provided with Ni (nickel) coating layer and Al (alminium) coating layer on the Ni layer before being inserted into the aluminium alloy tube.

DESCRIPTION OF THE PREFERRED EMBODIMENT

Below, a preferred embodiment of the present invention will be described in detail with reference to the accompanying drawings.

Figure 1:
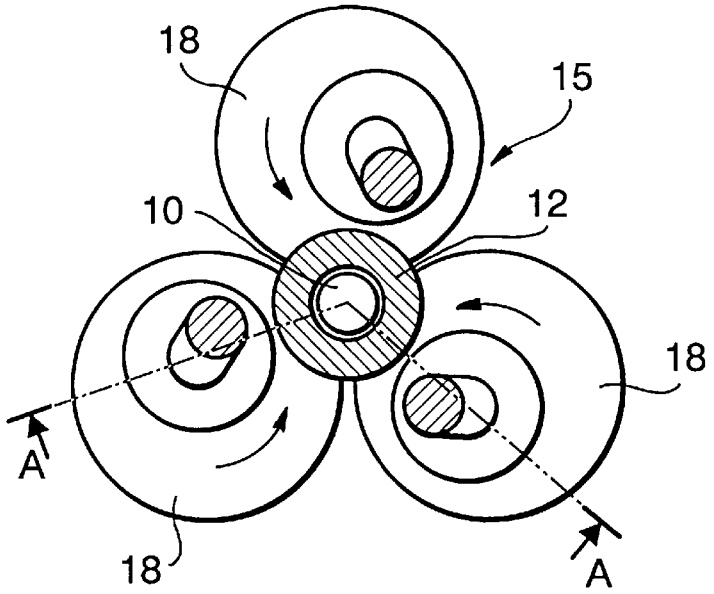
FIG. 1 is a front view of an embodiment of the present invention.
Figure 2:
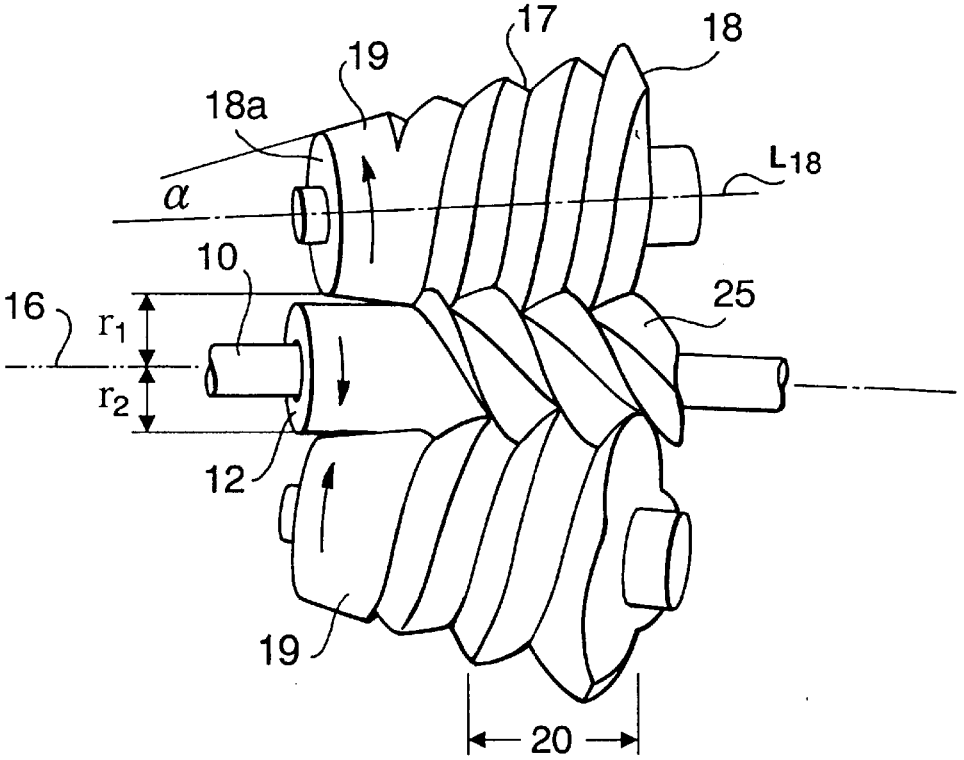
FIG. 2 is a side view from the A—A line of FIG. 1.
Figure 3:
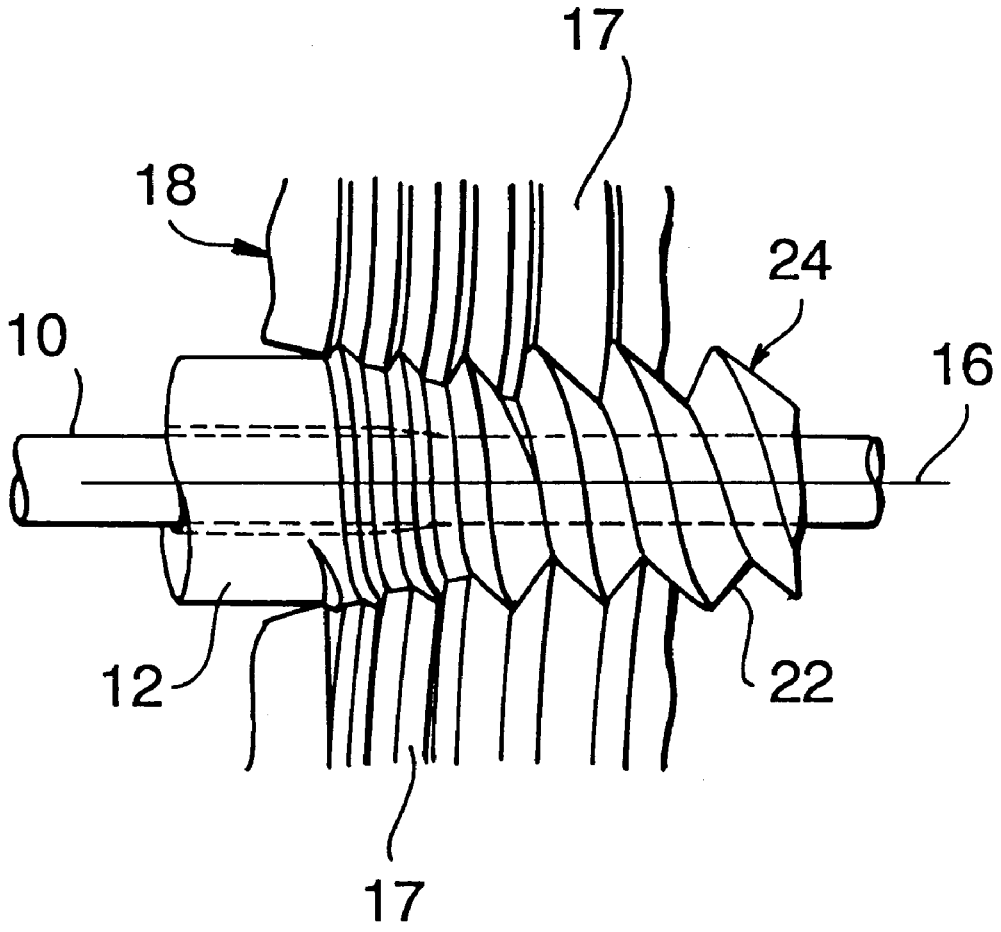
FIG. 3 is a sectional view showing a processed state of a material during the processing according to the present invention.

FIGS. 1–3 show an example of processing a screw rotor (Lysholm shape type) for a supercharger. FIG. 1 is a front view showing an embodiment of the present invention. FIG. 2 is a side view from the A—A line of FIG. 1. FIG. 3 shows a side sectional view showing a rolling/spreading state of a rotor that is being processed.

In FIGS. 1–3, a shaft member 10 is a core member of a rotor that is to be molded by rolling and is made from iron-related material such as carbon steel of general structure or SUS. An aluminium alloy tube 12 is made from extensible aluminium alloy or the like such that it is hollow inside but still has enough thickness of its wall.

The inner diameter of the aluminium alloy tube 12 is designed such that it is slightly larger than the outer diameter of the shaft member 10 to be inserted into the aluminium alloy tube 12.

The shaft member 10 is inserted into the aluminium alloy tube 12. Then, the aluminium alloy tube 12 with the shaft member 10 inside it is continuously fed through a pass line 16 of a slanted rolling machine 15 described hereinbelow.

The slanted rolling machine 15, as shown in FIGS. 1 and 2, has rolls 18 arranged around the pass line 16. Each roll 18 is formed to have a substantially corn shape with a predetermined half-corn angle alpha (Ref. FIG. 2). In the arrangement shown in the drawings, three rolls 18 are provided around the pass line 16 as a set with 120 degrees of separation angle between each. Each roll 18 has a plurality of spiral shaped grooves 17 formed around a portion of its side surface.

Further, each roll 8 is arranged around the pass line 16 such that its longitudinal axis L 18 inclines against the pass line 16 by a desired degree. The side surface 19 of each roll 18 around a smaller sectional circle 18*a* is formed like a smooth side surface of a cone. The minimum distance r1 between the side surface 19 and the pass line 16 in the direction perpendicular to the pass line 16 is kept larger than the radius r2 of the aluminium alloy tube 12 at the smaller sectional circle 18*a*, allowing easy swallowing of the aluminium tube 12 into the rolling machine 15. On the other hand, as the radius of the roll 18 increases (that is, at the larger sectional circle of the roll 18 where r2 is larger than r1), the roll 18 has a plurality of spiral-shaped grooves 17 formed around it, constituting rolling portion 20.

Dimensions such as location, space, width and depth of the spiral-shaped grooves 17 are different in each roll 18 (However, the widths and depths of the spiral grooves 17 are substantially constant in each roll 18). Newly formed teeth of the aluminium alloy tube 12 that is being rolled by one of the rolls 18 is immediately lead to the spiral grooves 17 of the next roll 18 such that the aluminium alloy tube 12 is continuously molded. Depths of the spiral grooves 17 in each roll 18 are varied between the rolling start point and the rolling end point such that a desired teeth height can be obtained at the completion of rolling.

Next, a processing method will be described hereinafter.

First, the aluminium alloy tube 12 as a material to be rolled is heated to a predetermined temperature (400–500 degrees (Celsius), approximately,) in an oven (not shown) and a shaft member 10 is inserted into the heated aluminium alloy tube 12. The aluminium alloy tube 12 with the shaft member 10 inside it is then directly fed into the pass line 16 of the slanted rolling machine 15. Consequently, the aluminium alloy tube 12 is rolled and a plurality of spiral-shaped teeth 22 is formed on the periphery of the tube 12 as shown in FIG. 3. Also, the aluminium alloy tube 12 is metallurgically attached to the shaft member 10 because its 12 internal surface shrinks as the result of the rolling.

More specifically, when the slanted rolling machine 15 starts rolling the aluminium alloy tube 12, the aluminium alloy tube 12 is swallowed and bit by each roll 18, 18, 18 sequentially and rolled at three positions in the transversal (circular) direction. The aluminium alloy tube 12 advances with rotating about its axis as being rolled. In short, rolling is spirally performed as the aluminium alloy tube 12 advances toward the direction of the larger radius of the roll 18 such that the three rolls 18 sequentially roll/spread the aluminium alloy tube 12 in the axial (advance) direction and the metallurgical attaching the tube 12 to the shaft member 10 can be achieved simultaneously.

Rolling/spreading factor in this case is set at 1.5 (preferably at 2.0) since the larger the factor is the more stable attachment is achieved. In order to get a still more stable attachment condition, a Ni (nickel) coating layer of a few micrometers may be provided beforehand on the shaft member 10 as a backing with an Al (alminium) coating layer of a few micrometers on top of the Ni coating.

The resulting rolled and molded near net shaped body 24 is cut into pieces of desired lengths. Shafts of iron or the like are connected to the both end surfaces of the shaft member 10 by friction welding such that the shaft member 10 can be coupled with bearings or gears.

Though the aluminium alloy tube 12 is heated to 400–500 degrees (Celsius) and hot-rolled in the embodiment described above, it 12 may also be processed by cold-rolling. Or, instead of heating the aluminium alloy tube 12 in the oven before rolling, heating the tube 12 while it is traveling through the pass line 16, as by placing the pass line 16 in the oven, is also acceptable.

Experiment 1.

Shape of a clad screw at product stage:

| | |
|---|---|
| Teeth top diameter; 75 mm | Teeth bottom diameter; 37 mm |
| Teeth height; 19 mm | Pitch; 45 mm |
| Number of spirals; 3 | Lead; 135 mm |

Material:

External layer member; Aluminium alloy tube containing Si of 12%

Outer diameter 70 mm, Inner diameter 40 mm

Heated to 480 degrees (Celsius)

Shaft member; S45C External diameter 39 mm

Not heated

Roll:

| | |
|---|---|
| Outlet side teeth top diameter; 200 mm | |
| Outlet side teeth bottom diameter; 162 mm | |
| Number of spirals of teeth; 6 | Number of rotation per time; 100 rpm |

A clad screw of dimensions described above was successfully molded by processing the material with the rolls having characteristics as above.

After the rolling, the aluminium alloy tube as an external layer member was rolled/spread by a rolling/spreading factor of about 1.8.

The attachment strength of the resulting clad screw corresponded to about 80% of the attachment strength of the original aluminium alloy.

Experiment 2.

The roll was set under the same conditions as in Experiment 1. External diameter of the aluminium alloy tube as the material to be rolled was increased like 70, 75, 78 mm as shown below such that the rolling/spreading factor became larger.

| Diameter of Material | Rolling/ Spreading Factor | Attachment Strength | Attachment Strength (Product)/ Attachment Strength (Material) |
|---|---|---|---|
| 70 | 1.8 | 12.2 | 80% |
| 75 | 2.2 | 14.5 | 95% |
| 78 | 2.5 | 15.0 | 98% |

As understood from the results, the attachment strength increases as the rolling/spreading factor becomes larger. When the rolling/spreading factor exceeds 2, attachment strength equivalent to that of the original material can be obtained.

Experiment 3.

Conditions were the same as those in Experiment 2 except that the Ni coating and al coating were provided on the S45C (the shaft member) beforehand.

| Diameter of Material | Rolling/ Spreading Factor | Attachment Strength | Attachment Strength (Product)/ Attachment Strength (Material) |
|---|---|---|---|
| 70 | 1.8 | 14.5 | 95% |
| 75 | 2.2 | 15.0 | 98% |
| 78 | 2.5 | 15.2 | 99% |

Thus, providing Ni and Al coatings enhances the attachment strength.

Accordingly, it has been experimentally confirmed that the method for processing a rotor of the present invention achieves processing material to the near net shape with hugely reduced production cost.

What is claimed is:

1. A method of processing a screw rotor said method comprising the steps of:

providing a slanted rolling machine that includes corn shape rolls arranged about a pass line along which a material to be processed advances, each corn shape roll having a plurality of spiral shaped grooves formed on its side surface and having a longitudinal axis inclining against the pass line;

inserting a shaft member made from iron or a similar material into an aluminum alloy tube;

continuously feeding the aluminum alloy tube with the shaft member inside it to the slanted rolling machine through the pass line; and rolling/spreading the periphery of the aluminum alloy tube by the corn shape rolls for forming spiral shaped teeth on the tube and for cladding the tube to the shaft member.

2. The method of processing a screw rotor as defined in claim 1, wherein the step of rolling/spreading is performed as a hot-rolling or a cold-rolling of the aluminum alloy tube by the slanted rolling machine with a rolling/spreading factor of larger than 2.

3. The method of processing a screw rotor as defined in claim 2, further including the steps of first heating the aluminum alloy tube to 400–500 degrees (Celsius), then inserting the shaft member into the heated tube, and then feeding the aluminum alloy tube with the shaft member in it into the slanted rolling machine.

4. The method of processing a screw rotor as defined in claim 3, further including the steps of first providing a Ni (nickel) coating layer on the external surface of the shaft member as a backing and an Al (aluminum) coating layer over the Ni coating layer, and then inserting the shaft member into the aluminum alloy tube.

5. The method of processing a screw rotor as defined in claim 4, further including the step of cutting the resulting rolled/spread near net shaped body into pieces of desired lengths and attaching shafts made from iron or the like to both end surfaces of the cut shaft member by friction welding.

6. The method of processing a screw rotor as defined in claim 1, wherein said slanted rolling machine is provided with three corn shaped rolls arranged as one set around the pass line with a separation angle of 120 degrees between each roll.

7. The method of processing a screw rotor as defined in claim 1, further including the steps of providing an oven receiving the pass line, and heating the aluminum alloy tube by moving the tube along the pass line and through the oven so that the tube is heated during its traveling through the oven.

* * * * *